US010292892B2

(12) United States Patent
Lee et al.

(10) Patent No.: US 10,292,892 B2
(45) Date of Patent: May 21, 2019

(54) PNEUMATIC LOWER EXTREMITY GAIT REHABILITATION TRAINING SYSTEM

(71) Applicant: LUNGHWA UNIVERSITY OF SCIENCE AND TECHNOLOGY, Taoyuan (TW)

(72) Inventors: Ching-Sheng Lee, Taoyuan (TW); I-Hsun Li, Taoyuan (TW); Hsin-Han Chiang, Taoyuan (TW); Lian-Wang Lee, Taoyuan (TW); Fu-Chen Hong, Taoyuan (TW); Rui-Peng Chen, Taoyuan (TW); Wei-Gan Chen, Taoyuan (TW)

(73) Assignee: Lunghwa University of Science and Technology, Taoyuan (TW)

( * ) Notice: Subject to any disclaimer, the term of this patent is extended or adjusted under 35 U.S.C. 154(b) by 247 days.

(21) Appl. No.: 15/262,250

(22) Filed: Sep. 12, 2016

(65) Prior Publication Data

US 2018/0071580 A1 Mar. 15, 2018

(51) Int. Cl.
*A61H 3/00* (2006.01)

(52) U.S. Cl.
CPC ..... *A61H 3/008* (2013.01); *A61H 3/00* (2013.01); *A61H 2201/164* (2013.01); *A61H 2201/1628* (2013.01); *A61H 2201/1676* (2013.01)

(58) Field of Classification Search
None
See application file for complete search history.

(56) References Cited

U.S. PATENT DOCUMENTS 7,628,766 B1 * 12/2009 Kazerooni ..... A61F 5/00 601/35
2004/0116839 A1 * 6/2004 Sarkodie-Gyan ..... A61H 3/008 601/35
2005/0101448 A1 * 5/2005 He ..... A61H 1/0237 482/54
2010/0270771 A1 * 10/2010 Kobayashi ..... A61H 3/008 280/210

* cited by examiner

*Primary Examiner* — Sundhara M Ganesan
(74) *Attorney, Agent, or Firm* — Rosenberg, Klein & Lee

(57) ABSTRACT

A pneumatic lower extremity gait rehabilitation training system includes a support device for reducing the burden of supporting a user's body weight by lower extremity in a walking therapy, an exoskeleton rehabilitation device for adjusting the user's walking coordination at a treadmill, a center-of-gravity adjusting device for adjusting a change of upper and lower centers of gravity, and a remote monitoring device for receiving and capturing a signal of an angle displacement of a joint mechanism in a walking cycle. The user may support her/his body weight by the support device and the center-of-gravity adjusting device to reduce the gravity exerted onto the user's legs. The exoskeleton rehabilitation device improves the flexibility, safety and light-weight of walking and requires fewer driving elements. The remote monitoring device sends analyzed signals to the treadmill to adjust the user's walking speed, so as to improve the rehabilitation effect.

12 Claims, 6 Drawing Sheets

PNEUMATIC LOWER EXTREMITY GAIT REHABILITATION TRAINING SYSTEM

FIELD OF THE INVENTION

The present invention relates to a pneumatic lower extremity gait rehabilitation training system, more particularly to the system that uses an exoskeleton rehabilitation device for the rehabilitation of a user's lower extremity.

BACKGROUND OF THE INVENTION

As science and technology advance and our living standard improves, many countries enter an aging society, and various health issues of the aging population become a growing concern, and there are numerous patients of neurological diseases and cerebral vascular diseases in the elderly population. For example, a central nervous system damage caused by the factors such as stroke, spinal cord injury, brain dysfunction, and Parkinson's disease may result in patients with varying degrees of limb movement dysfunction. In severe cases, paralysis or hemiplegia may occur. In addition, the number of patients with nerve or limb injuries caused by car accidents becomes increasingly larger. The walking function of the lower extremity is an important index for movement ability and also ensures the necessary conditions of a normal independent life, so that the daily life of most patients of car accidents is affected, and such accidents and injuries definitely bring burdens and challenges to family.

Although most patients of central nervous system damage can recover to an extent of capable of walking independently after surgical or medical treatments, yet after-effects are accompanied. For example, the motion control capability drops, the joints are stiff, and the walking gait is abnormal. As a result, the patient's balance function drops, so as to seriously affect the patient's motion capability and quality of life. Rehabilitation theories and clinical experiments show that correct scientific rehabilitation training has significant effect on the recovery and improvement of the patient's motion capability, in addition to the early surgery and medical treatment. A better recovery can be achieved if the patient takes the rehabilitation training at an early stage after the acute period, wherein the theory of motion rehabilitation therapy bases on the plasticity of our brain, and related medical researches show that although damaged neurons cannot regenerate, yet the lost functions of nerve tissues can be recovered by functional reorganization or compensation. In other words, the brain has the feature of plasticity. Both animal and human tests show that active or passive repetitive training of specific functions of limbs can stimulate proprioceptors and drive the mapping area of central nervous system to have a change and the plasticity of the brain function to occur. However, most of the present rehabilitation therapies rely on a manual method which limits the efficiency and effectiveness of the rehabilitation training, and the equipments of the rehabilitation therapy are relatively simple and unable to meet the patient's rehabilitation requirements.

As robotics advances and the market of rehabilitation therapy expands, the conventional rehabilitation training can be improved. Designing a safe, quantitative, effective and repetitive limb rehabilitation training system becomes an urgent and important issue to modern rehabilitation and treatment, so that rehabilitation robots are introduced and important medical bases are provided. The rehabilitation robot is an important branch of medical robots, and the study of rehabilitation robot integrates different fields including rehabilitation therapy, biomechanics, mechanics, material mechanics, mechanism, electronics, computer science, and robotics. The main difference between rehabilitation robot and industrial robot resides on that the rehabilitation robot acts directly on human body and works with a patient in the same operating space, so that the patient and the rehabilitation robot conduct an overall coordinative motion, and the rehabilitation robot is controlled by a computer and installed with corresponsive sensors and safety systems, and the motion parameters can be adjusted automatically according to the patient's actual needs, so as to achieve the best training. Obviously, the rehabilitation robot can improve the rehabilitation training effect and make the trained motion to be closer to a health condition. In the meantime, the rehabilitation robot also can reduce the laborious training task of a rehabilitation therapist and allow the rehabilitation therapist to spend more efforts on related rehabilitation researches.

In present domestic and foreign researches, the lower extremity drivers of most gait rehabilitation robots adopt a servomotor and a ball screw to convert the rotational motion of the motor into a linear motion in order to drive a link rod mechanism of a power-assisted exoskeleton leg to complete a joint motion, and its features include high-precision position control and easiness of control. However, the deficiencies reside on that most of the power are consumed on the motor and a retardation system, so that the performance is relatively low. Since the motor driving system has a high rigidity and has a relatively large impact to the patient, therefore the patient's leg or other tissues may be injured easily if the system has a sudden change of displacement. Obviously, the rehabilitation training system driven by a motor has less flexibility and lower safety. In addition, the structure of the motor-driven system is more complicated, so that the equipment is large to provide the degree of freedom for the exoskeleton legs.

In view of the aforementioned drawbacks of the prior art, the inventor of the present invention based on years of experiments to conduct extensive researches and experiments, and finally developed a pneumatic lower extremity gait training system in accordance with the present invention to overcome the drawbacks of the prior art.

SUMMARY OF THE INVENTION

Therefore, it is a primary objective of the present invention to overcome the issue of the conventional gait rehabilitation robot having a motor-driven system with a large rigidity that many impose a large impact on patients and injury the patient's leg or other tissues. In addition, the structure of the motor-driven system is complicated, so that the equipment will be very large to provide the degree of freedom for the power-assisted exoskeleton leg.

To achieve the aforementioned and other objectives, the present invention provides a pneumatic lower extremity gait rehabilitation training system, comprising: an exoskeleton rehabilitation device, including a first hip joint mechanism, with a first hip joint outward-extending cylinder frame and a second hip joint outward-extending cylinder frame installed to an end the first hip joint mechanism, and the first hip joint outward-extending cylinder frame and the second hip joint outward-extending cylinder frame being installed to a first pneumatic device, and the first hip joint mechanism being installed to a second hip joint mechanism, and the second hip joint mechanism being installed to a hip joint cylinder frame, and the hip joint cylinder frame being pivotally coupled to a first cylinder device, and the first cylinder device being coupled to a processing unit, and the first hip joint mechanism being pivotally coupled to a thigh frame, and the thigh frame being installed to a knee joint mechanism, and the thigh frame and the knee joint mechanism being pivotally coupled to a first actuator, and the knee joint mechanism being pivotally coupled to a calf frame, and the calf frame being pivotally coupled to a second actuator, and the second actuator being coupled to the processing unit, and the knee joint mechanism and the calf frame being pivotally coupled to a third actuator, and the third actuator being coupled to the processing unit, and the first actuator and the second actuator being pivotally coupled to a second cylinder device, and the calf frame being installed to an ankle joint mechanism, and the ankle joint mechanism and the third actuator being installed to a second pneumatic device, and the ankle joint mechanism being installed to a pedal device.

In the pneumatic lower extremity gait rehabilitation training system, the first hip joint mechanism is pivotally coupled to a first non-contact angle sensor, and the knee joint mechanism is pivotally coupled to a second non-contact angle sensor, and the ankle joint mechanism is pivotally coupled to a third non-contact angle sensor, and the first non-contact angle sensor, the second non-contact angle sensor and the third non-contact angle sensor are provided for capturing signals of an angle displacement of the first hip joint mechanism, the knee joint mechanism and the ankle joint mechanism in a walking cycle of the exoskeleton rehabilitation device, so as to send each signal to the processing unit, and the processing unit controls the exoskeleton rehabilitation devices of the first actuator, the second actuator and the third actuator.

In the pneumatic lower extremity gait rehabilitation training system, the thigh frame further includes a thigh-length adjustment mechanism, and the calf frame further includes a calf-length adjustment mechanism, for adjusting the lengths of the user's thigh and calf respectively.

In the pneumatic lower extremity gait rehabilitation training system, the exoskeleton rehabilitation device further includes at least one fixing element.

In the pneumatic lower extremity gait rehabilitation training system, the processing unit is coupled to a remote monitoring device, and the remote monitoring device is provided for receiving the signals of angle displacement of the hip joint mechanism, the knee joint mechanism and the ankle joint mechanism within the walking cycle of the first non-contact angle sensor, the second non-contact angle sensor and the third non-contact angle sensor respectively.

The pneumatic lower extremity gait rehabilitation training system further comprises a support device, configured to be corresponsive to an end of the exoskeleton rehabilitation device, and the support device has at least one pulley, being installed symmetrically at an end of the support device, and linked by a transmission unit, and an end of the transmission unit is installed to a cylinder mechanism and a pressure relief valve, and the cylinder mechanism has the pressure relief valve, and an end of the cylinder mechanism is installed to an end of the transmission unit by a cylinder fixing plate, and the other end of the cylinder mechanism is fixed to an end of the support device, and the other end of the transmission unit is coupled to a balance bar, and an end of the balance bar has a suspension device, and the suspension device has a sheath portion.

In the pneumatic lower extremity gait rehabilitation training system, the suspension device further includes a pulling-force sensor for sending the center of gravity to stabilize the center of gravity of the support device.

In the pneumatic lower extremity gait rehabilitation training system, bottom end of the support device further includes at least one moving device and at least one fixing device, and the support device may be move horizontally by the moving device, and the support device may be positioned by the fixing device.

In the pneumatic lower extremity gait rehabilitation training system, the support device further a center-of-gravity adjusting device installed to the support device by a first adjusting plate, and the first adjusting plate is pivotally coupled to a first link rod, a second link rod, a third link rod and a fourth link rod, and the first link rod and the first adjusting plate are pivotally coupled to a first gas driving unit, and the second link rod and the first adjusting plate are pivotally coupled to a second gas driving unit, and the first adjusting plate is installed to a second adjusting plate by the first link rod, the second link rod, the third link rod and the fourth link rod, and the second adjusting plate is installed to the second hip joint mechanism.

In the pneumatic lower extremity gait rehabilitation training system, the processing unit is coupled to a treadmill, and the treadmill is installed with a speed sensor.

Compared with the prior art, the system of the present invention has the following advantages and effects:

1. A user may use the suspension device and the center-of-gravity adjusting device to support her/his body weight to reduce the force imposed on the user's legs and the burden of the body weight supported by the user's lower extremity, so as to achieve the best training effect.

2. Compared with the conventional gait rehabilitation training system, the system of the present invention includes an exoskeleton leg rehabilitation device driven by the first cylinder device, the second cylinder device, the first pneumatic device and the second pneumatic device exoskeleton rehabilitation device. The degree of freedom of the exoskeleton rehabilitation device driven by the cylinder devices and pneumatic devices, the simulation analysis based on kinematics and dynamics, the air pressure and electric control circuit design, and the selection of sensors and mechanical materials, the mechanical components of the machinery improve the flexibility, safety and lightweight significantly, and the system requires fewer driving elements, and the structure is simple rather than complex.

3. The coordination between the system of the present invention and the user is controlled by capturing the information related to the conditions of each joint and both legs within a user's walking cycle, so that the user can obtain the best rehabilitation training, and the effect of the walking rehabilitation can be improved.

4. The bottom of the support device of the present invention has a moving device and a fixing device, so that the user can move the support device by the moving device before/after the rehabilitation, and step on/down the treadmill easily. During the rehabilitation, the support device is fixed by the fixing device and cannot be moved easily, so as to improve the safety of the rehabilitation.

DESCRIPTION OF THE PREFERRED EMBODIMENTS

The technical characteristics of the present invention will become apparent from the following detailed description of a preferred embodiment with reference to the accompanying drawings.

Figure 1:
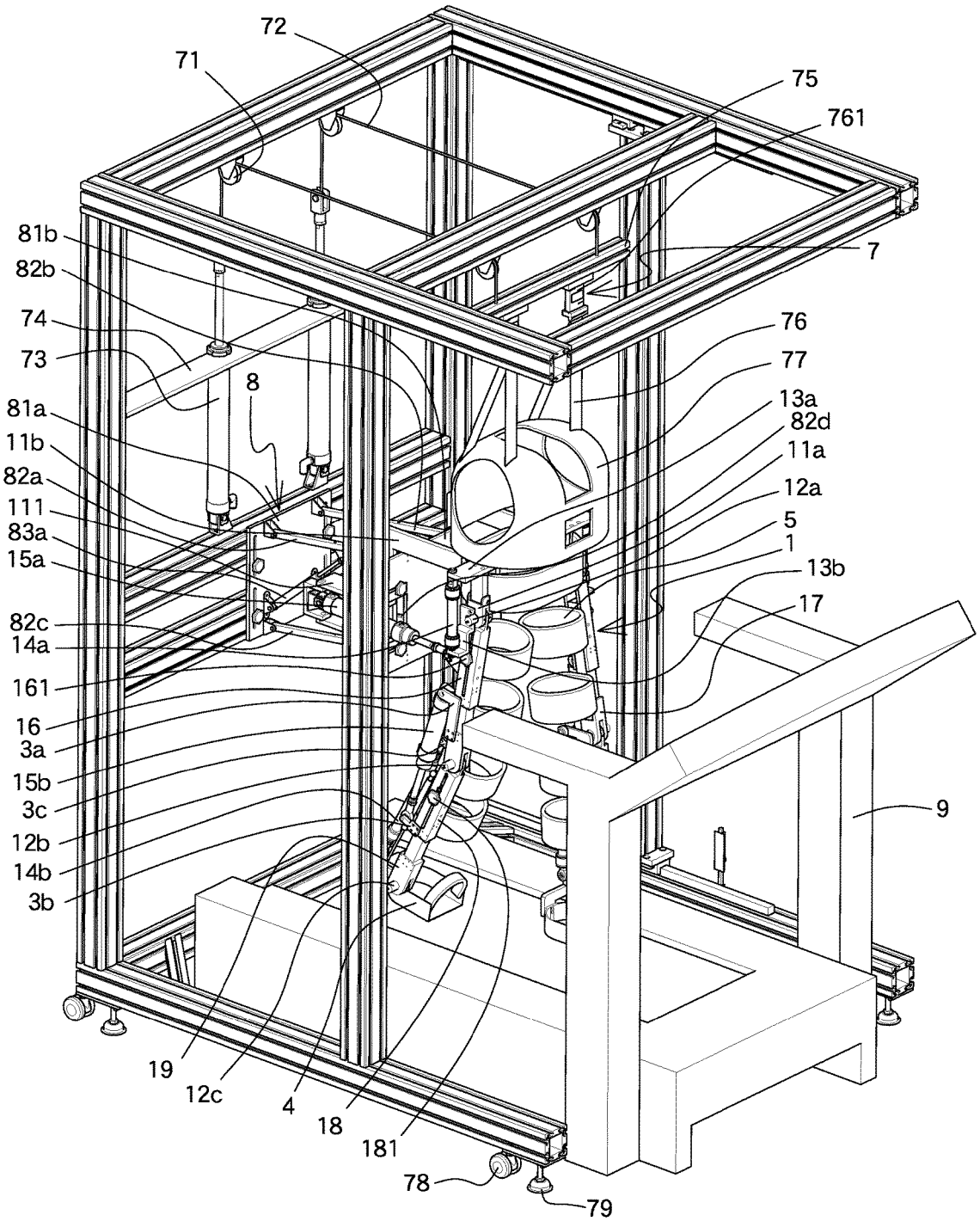
FIG. 1 is a perspective view of the present invention.
Figure 2:
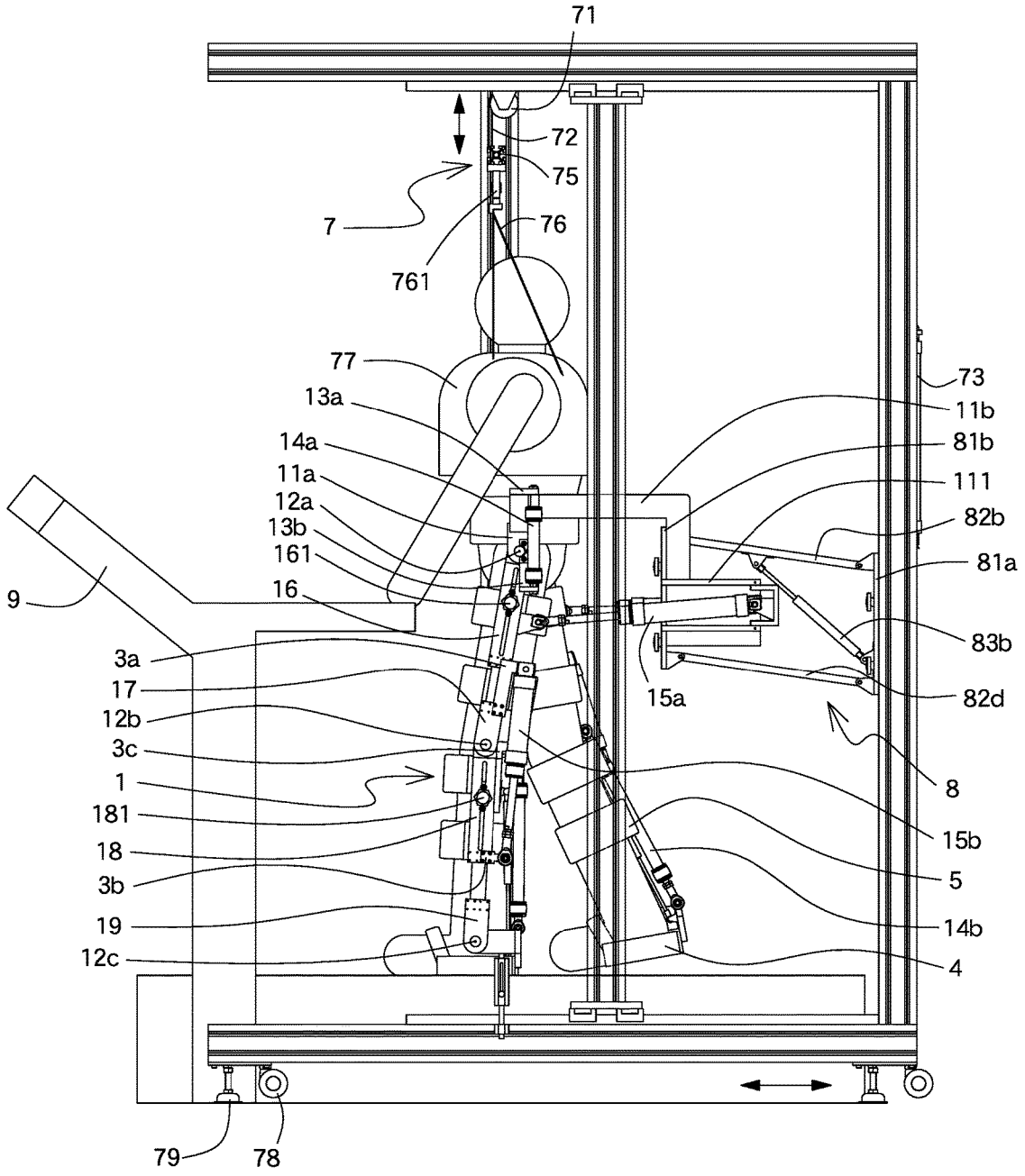
FIG. 2 is a schematic view of an operation of a support device of the present invention.
Figure 3:
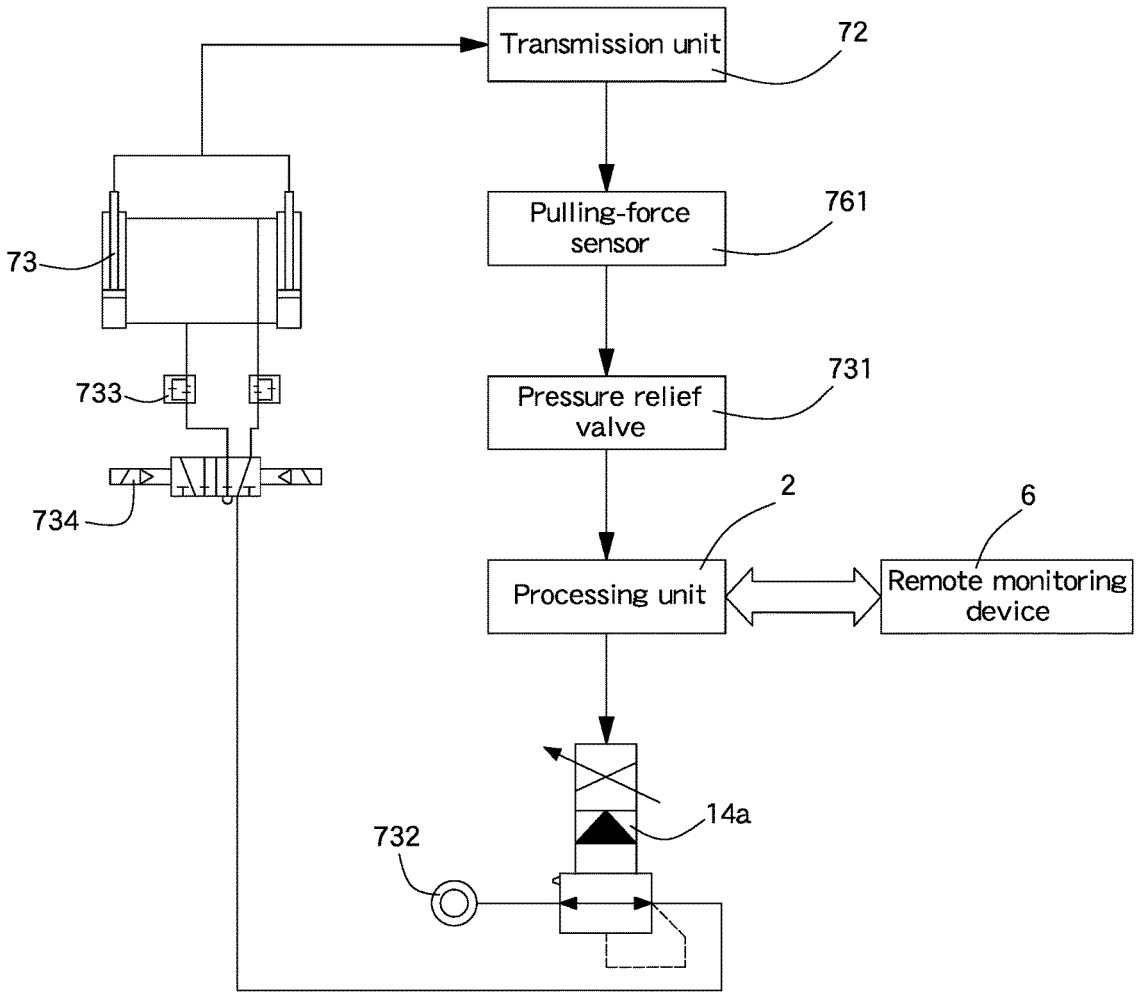
FIG. 3 is a schematic block diagram of a support device of the present invention.

With reference to FIGS. 1 to 3 for a pneumatic lower extremity gait rehabilitation training system of the present invention, the pneumatic lower extremity gait rehabilitation training system, comprises:

an exoskeleton rehabilitation device 1, having a first hip joint mechanism 11*a* pivotally coupled to a first non-contact angle sensor 12*a*, and an end of the first hip joint mechanism 11*a* being installed to a first hip joint outward-extending cylinder frame 13*a* and a second hip joint outward-extending cylinder frame 13*b*, and the first hip joint outward-extending cylinder frame 13*a* and the second hip joint outward-extending cylinder frame 13*b* being installed to a first pneumatic device 14*a*, and the first hip joint mechanism 11*a* being installed to a second hip joint mechanism 11*b*, and the second hip joint mechanism 11*b* being installed to a hip joint cylinder frame 111, and the hip joint cylinder frame 111 being pivotally coupled to a first cylinder device 15*a*, and the first cylinder device 15*a* being coupled to a processing unit 2, the first hip joint mechanism 11*a* being pivotally coupled to a thigh frame 16, and the thigh frame 16 further having a thigh-length adjustment mechanism 161, for adjusting the length of the user's thigh, and the thigh frame 16 being installed to a knee joint mechanism 17, and the knee joint mechanism 17 being pivotally coupled to a second non-contact angle sensor 12*b*, and the thigh frame 16 and the knee joint mechanism 17 being pivotally coupled to a first actuator 3*a*, and the knee joint mechanism 17 being pivotally coupled to a calf frame 18, and the calf frame 18 further having a calf-length adjustment mechanism 181 for adjusting the length of the user's calf, and the calf frame 18 being pivotally coupled to a second actuator 3*b*, and the second actuator 3*b* being coupled to the processing unit 2, and the knee joint mechanism 17 and the calf frame 18 being pivotally coupled to a third actuator 3*c*, and the third actuator 3*c* being coupled to the processing unit 2, and the first actuator 3*a* and the second actuator 3*b* being pivotally coupled to a second cylinder device 15*b*, and the calf frame 18 being installed to an ankle joint mechanism 19, and the ankle joint mechanism 19 being pivotally coupled to a third non-contact angle sensor 12*c*, and the ankle joint mechanism 19 and the third actuator 3*c* being installed to a second pneumatic device 14*b*, and the ankle joint mechanism 19 being installed to a pedal device 4, and the first non-contact angle sensor 12*a*, the second non-contact angle sensor 12*b* and the third non-contact angle sensor 12*c* capturing signals of an angle displacement of the hip joint mechanism, the knee joint mechanism 17 and the ankle joint mechanism 19 within a walking cycle, and each signal being transmitted to the processing unit 2, and the processing unit 2 being provided for controlling the exoskeleton rehabilitation device 1 of the first actuator 3*a*, the second actuator 3*b* and the third actuator 3*c;* at least one fixing element 5, installed to the exoskeleton rehabilitation device 1, and fixed to a user's lower extremity;

a remote monitoring device 6, coupled to the processing unit 2, for receiving signals of angle displacement of the first hip joint mechanism 11*a*, the knee joint mechanism 17 and the ankle joint mechanism 19 detected by the first non-contact angle sensor 12*a*, the second non-contact angle sensor 12*b* and the third non-contact angle sensor 12*c* within a walking cycle of the exoskeleton rehabilitation device 1;

a support device 7, configured to be corresponsive to an end of the exoskeleton rehabilitation device 1, and having at least one pulley 71 symmetrically installed at an end of the support device 7 and linked to a transmission unit 72, and an end of the transmission unit 72 being installed with a cylinder mechanism 73 and a pressure relief valve 731, and the cylinder mechanism 73 having the pressure relief valve 731, and an end of the cylinder mechanism 73 being installed to an end of the transmission unit 72 by a cylinder fixing plate 74, and the other end of the cylinder mechanism 73 being fixed to an end of the support device 7, and the other end of the transmission unit 72 being coupled to a balance bar 75, and an end of the balance bar 75 having a suspension device 76, and the suspension device 76 further having a pulling-force sensor 761, for sending the center of gravity to stabilize the center of gravity of the support device 7, and the suspension device 76 having a sheath portion 77, and the bottom of the support device 7 further having at least one moving device 78 and at least one fixing device 79, wherein the support device 7 may be moved horizontally by the moving device 78, and the support device 7 may be positioned by the fixing device 79;

a center-of-gravity adjusting device 8, installed to the support device 7, and mounted to the support device 7 by a first adjusting plate 81, and the first adjusting plate 81*a* being pivotally coupled to a first link rod 82*a*, a second link rod 82*b*, a third link rod 82*c* and a fourth link rod 82*d*, and the first link rod 82*a* and the first adjusting plate 81*a* being pivotally coupled to a first gas driving unit 83*a*, and the second link rod 82*b* and the first adjusting plate 81*a* being pivotally coupled to a second gas driving unit 83*b*, and the first adjusting plate 81*a* being installed to a second adjusting plate 81*b* by the first link rod 82*a*, the second link rod 82*b*, the third link rod 82*c* and the fourth link rod 82*d*, and the second adjusting plate 81*b* being installed to the second hip joint mechanism 11*b*; and a treadmill 9, coupled to the processing unit 2, and having a speed sensor (not shown in the figure).

In FIGS. 1 and 2, the user may move the support device 7 by the moving device 78 before/after the rehabilitation to step on/down the treadmill 9. During the rehabilitation, the user may use the fixing device 79 to fix the support device 7, so that the support device 7 will be moved easily. After the user is sheathed to the sheath portion 77, the suspension device 76 uses the pulley 71 and the transmission unit 72 to change the force applying direction of the cylinder mechanism 73 for a displacement. In addition, the cylinder mechanism 73 is fixed to the support device 7 by the cylinder fixing plate 74 and will not move easily during the rehabilitation process. According to the actual conditions of the user's lower extremity rehabilitation, an appropriate amount of the air pressure source 732 can be set by using the cylinder mechanism 73, and the throttle valve 733 and the directional control valve 734 of the cylinder mechanism 73 are used to adjust the pressure relief valve 731, and then the cylinder mechanism 73 controls balance bar 75 and pulling-force sensor 761 by the processing unit 2 to drive the suspension device 76 for a displacement, so as to appropriately reduce the gravity imposed on the user's legs, and the user can do the rehabilitation freely and achieve the best weight reduction effect and the best training effect.

In FIG. 3, the support device 7 is provided for the purpose of ensuring the gravity during the user's weight reduction training. According to the medical theory of rehabilitation, the most effective rehabilitation to users is that the weight loss should not exceed 30% (inclusively) of the user's body weight in a rehabilitation training. For example, most people have a weight less than 100 Kg, so that the weight loss should be less than 30 Kg. Taking the safety coefficient (=1.5) into consideration, the minimum output stress of each cylinder mechanism 73 should be greater than 225N.

Figure 4:
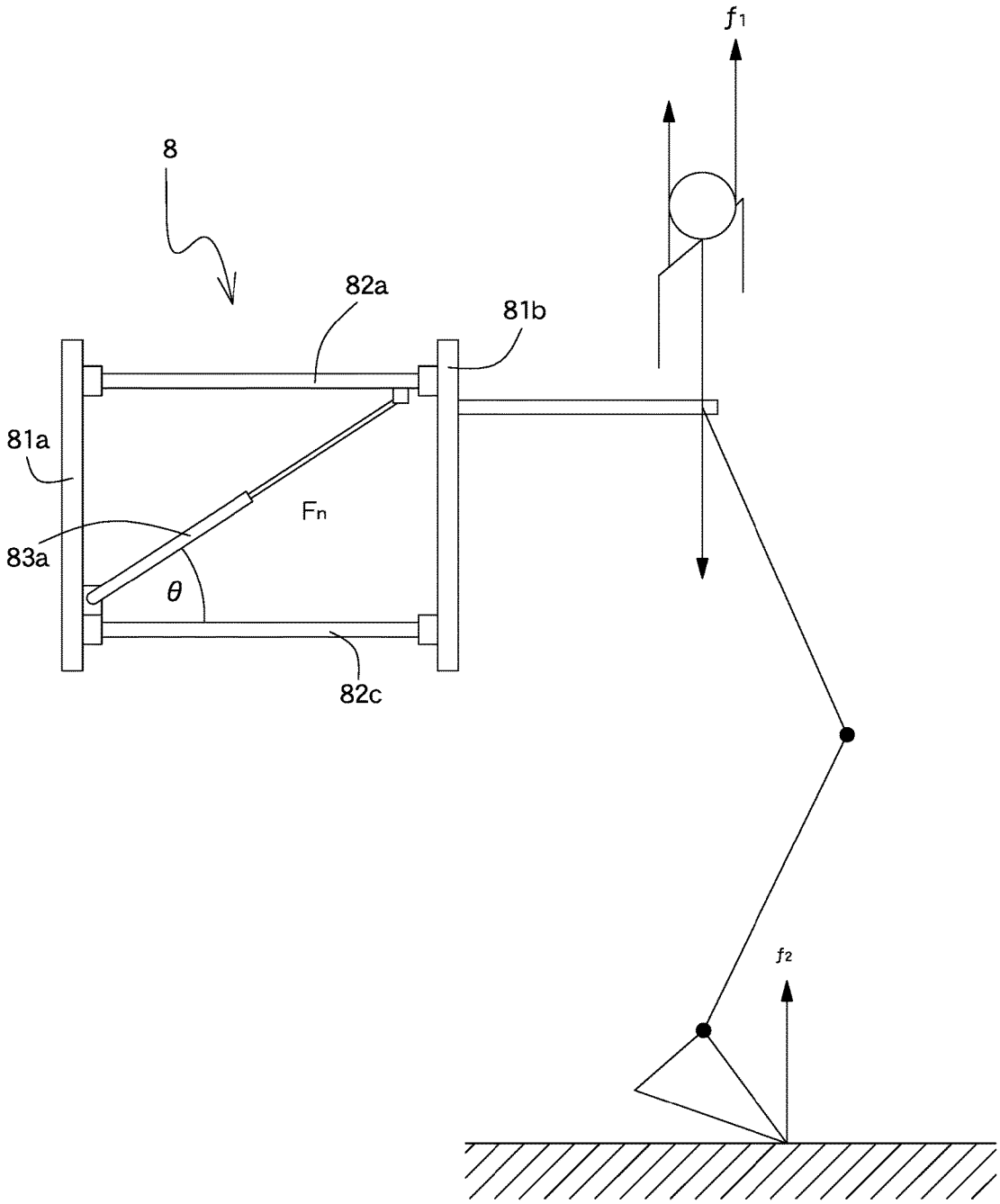
FIG. 4 is a schematic view of balancing and adjusting a center-of-gravity adjusting device of the present invention.

With reference to FIG. 4 for the center-of-gravity adjusting device 8 of the present invention, it is necessary to create a rod-like human body model, and the human body in the normal standing and walking process is analyzed, and the information of several specific situations including the highest and lowest centers of gravity are obtained to establish the three-dimensional mathematical equations to compute the track curve of the center of gravity in the standing and walking processes for human bodies of different heights, and the track curve is used as a reference for the design of the center-of-gravity adjusting device 8. The gravity of a human body is designed as a means for passively adjusting the gravity of the human body weight to obtain the variation of the gravity of a human body in normal standing and walking processes. The first gas driving unit 83*a* and the second gas driving unit 83*b* of the center-of-gravity adjusting device 8 have an elastic curve almost like a straight line, so that when the user's pressure is exerted onto the center-of-gravity adjusting device 8, the first link rod 82*a*, the second link rod 82*b*, the third link rod 82*c* and the fourth link rod 82 are pivotally coupled to the first adjusting plate 81*a* and the second adjusting plate 81*b* and pivoted according to the change of the applied force, and the first gas driving unit 83*a* and the second gas driving unit 83*b* are extended and contracted according to the change of pressure, so as to buffer a sudden change of pressure. The track of the gravity of a human body can be changed passively with the upward and downward displacements of the user's center of gravity.

In FIG. 4, the center-of-gravity adjusting device 8 simulates the normal change of the center of gravity of the human body, so that it is necessary to input the curve of a normal change of gravity of the human body during walking. However, the left-right and front-rear variations of the gravity of the human body are much smaller than the variations of the upper and lower gravities, so that the present invention simply inputs the change of upper and lower gravities. In other words, the change of stroke of the first gas driving unit 83*a* and the second gas driving unit 83*b* are used as a balancing mechanism of the gravity. Appropriate first gas driving unit 83*a* and second gas driving unit 83*b* are used for manufacturing the center-of-gravity adjusting device 8 and analyzing the motion. It is necessary to compute the changed stroke of the first gas driving unit 83*a* and the second gas driving unit 83*b*, and the mathematical equations of the center-of-gravity adjusting device 8 are given below:

$$\begin{cases} F_n = mg - f_1 - f_2 \\ F = \dfrac{F_n}{\sin\theta} \\ F = F_0 + K(L + \Delta L) \end{cases} \quad \text{[Equation 1]}$$

-continued $$\Delta L = \frac{(mg - f_1 - f_2 - KF_0)}{K\sin\theta}$$

In FIG. 4, $F_0$ and K are parameters related to the size of the first gas driving unit 83*a* and the second gas driving unit 83*b*, and $f_1$ is the force supported by the weight reduction mechanism and has a magnitude in range of 0~300N, and $f_2$ is a support force of a plantar and whose variation curve can be detected and obtained by the plantar force. With the aforementioned numerical values of each parameter, the stroke change of the first gas driving unit 83*a* and the second gas driving unit 83*b* can be calculated, and used for selecting the appropriate first gas driving unit 83*a* and second gas driving unit 83*b*.

Figure 5:
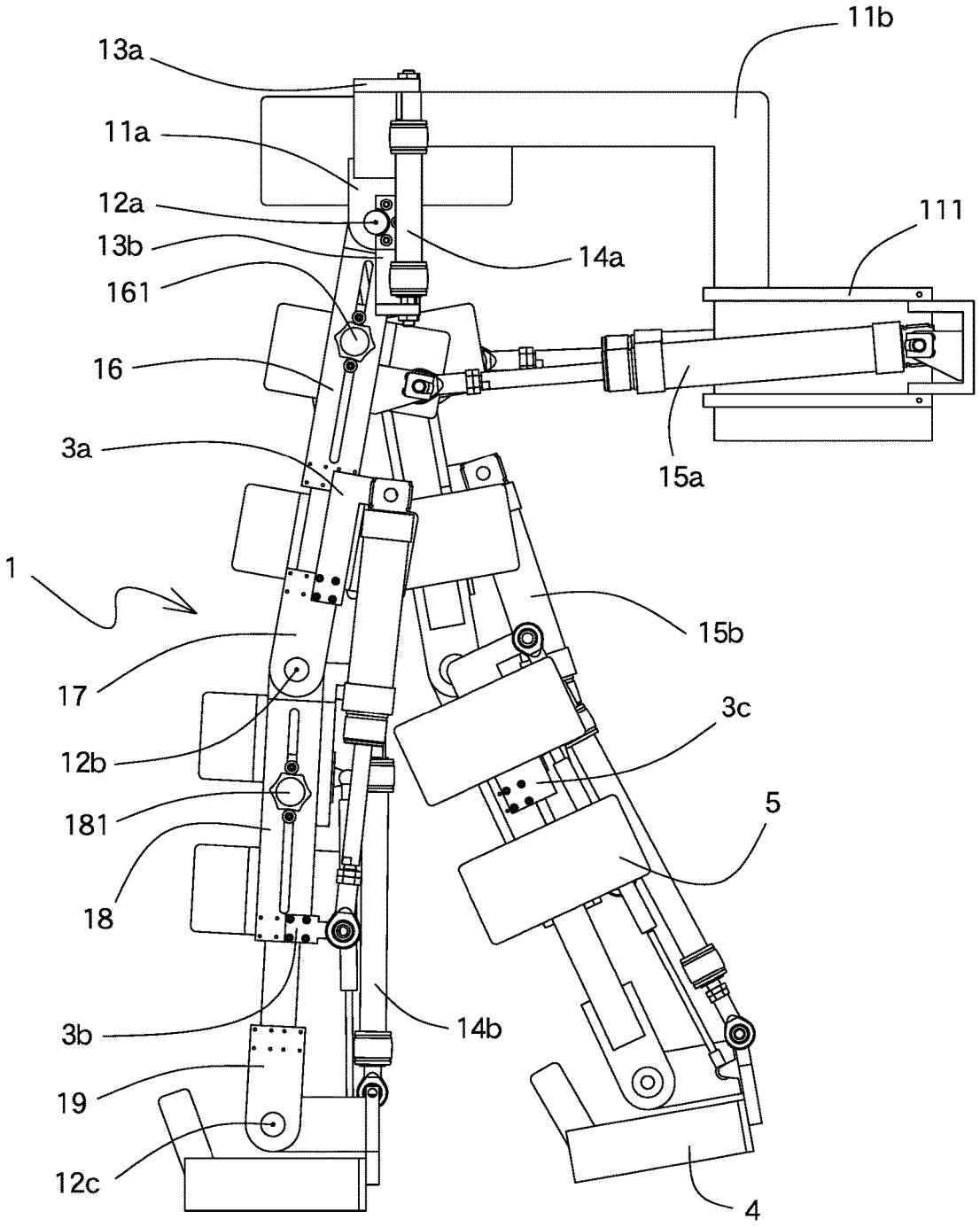
FIG. 5 is a schematic view of an operation of an exoskeleton rehabilitation device of the present invention.

Related researches show that various different rehabilitation methods can promote and improve the rehabilitation effect for the patient motion function if the patient can actively participate in the rehabilitation exercise, so that in the patient's active training mode, the exoskeleton rehabilitation device 1 needs a function of tracking the patient's lower extremity exercise. In FIG. 5, the user sheathes her/his lower extremity to the exoskeleton rehabilitation device 1 and fixes the lower extremity by the fixing element 5 for the rehabilitation exercise. The exoskeleton rehabilitation device 1 uses a pneumatic servo system as a driver, and the first hip joint mechanism 11*a*, the second hip joint mechanism 11*b* and the knee joint mechanism 17 control the movement of the first cylinder device 15*a* and the second cylinder device 15*b* by the proportional directional valves. As to the dorsal flexion and plantar flexion of the ankle joint mechanism 19 and the adduction and abduction of the hip joint mechanism, the proportional pressure valves are used for controlling the contraction and extension of the first pneumatic device 14*a*, the second pneumatic device 14*b*, the first actuator 3*a*, the second actuator 3*b* and the third actuator 3*c*. In addition, the single-leg exoskeleton rehabilitation device 1 is driven jointly by the first cylinder device 15*a* and the second cylinder device 15*b*, and the first pneumatic device 14*a* and the second pneumatic device 14*b*. Compared with the conventional gait rehabilitation training system, the exoskeleton rehabilitation device 1 of the present invention improves the flexibility, safety and lightweight significantly, and the invention requires fewer driving elements and a simple mechanical installation, so that users can be driven by the exoskeleton rehabilitation device 1 to perform a walking exercise on the treadmill 9, train the movement of each joint, and do the rehabilitation training with the function of actively and passively adjusting the leg muscles and the rehabilitation training for nerves. In addition, the first non-contact angle sensor 12*a*, the second non-contact angle sensor 12*b* and the third non-contact angle sensor 12*c* are provided for capturing signals of angle displacement of the first hip joint mechanism 11*a*, the knee joint mechanism 17 and the ankle joint mechanism 19 within a walking cycle of the exoskeleton rehabilitation device 1, and controlling the exoskeleton rehabilitation device 1 driven by the first cylinder device 15*a*, the second cylinder device 15*b*, the first pneumatic device 14*a*, the second pneumatic device 14*b*, the first actuator 3*a*, the second actuator 3*b* and the third actuator 3*c* to achieve the coordination between the training system and the user's exercise conditions. In addition, the user can use the thigh-length adjustment mechanism 161 and the calf-length adjustment mechanism 181 to adjust the length of the thigh frame 16 and the calf frame 18 for the best rehabilitation training and improve the rehabilitation quality for the injury and functional damage of the user's legs.

Figure 6:
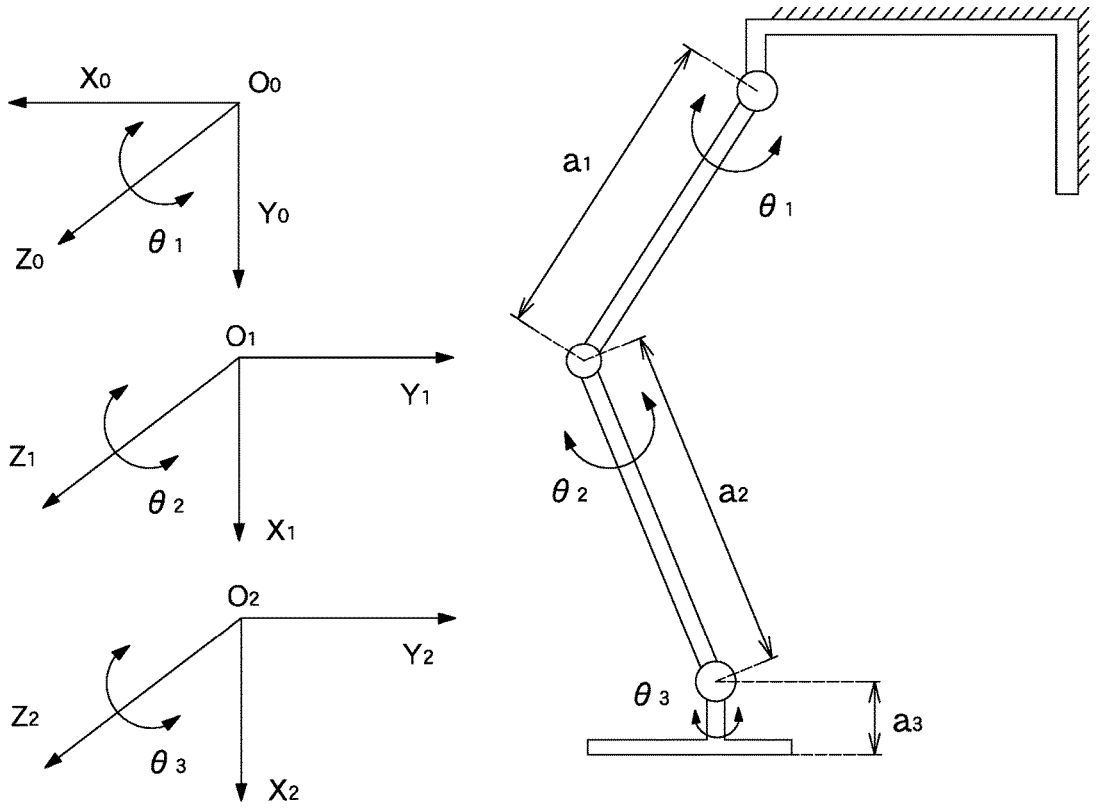
FIG. 6 is a schematic view of a coordinates system of a link rod of an exoskeleton rehabilitation device of the present invention.

Since the gait rehabilitation training of the present invention uses the treadmill 9 as a platform, therefore we should know about the track of the exoskeleton rehabilitation device 1 in space, particularly the motion track of the user's foot end before we can simulate the normal walking condition of the human body. In FIG. 6, the exoskeleton rehabilitation device 1 is a device designed by a D-H coordinate conversion method, and the spatial pose of an end of the power-assisted exoskeleton leg is analyzed to obtain a pose equation which includes the establishment of the D-H coordinate conversion parameter table and the derivation of forward and revere kinematics.

The information of each joint and both legs are obtained within the user's walking cycle, and the pressure relief valve 731 is adjusted by the cylinder mechanism 73 to set an appropriate weight reduction value which is sent to the remote monitoring device 6, and the information is transmitted by the processing unit 2 to control the coordination between the system of the present invention and the user, and the processing unit 2 transmits the information to the speed sensor of the treadmill 9 to adjust the speed of the treadmill 9, so that users can have the best rehabilitation training, and the invention improves the walking rehabilitation effect.

In summation, the present invention has the following advantages and effects:

1. A user may use the suspension device 76 and the center-of-gravity adjusting device 8 to support her/his body weight to reduce the force imposed on the user's legs and the burden of the body weight supported by the user's lower extremity, so as to achieve the best training effect.

2. Compared with the conventional gait rehabilitation training system, the system of the present invention includes an exoskeleton leg rehabilitation device 1 driven by the first cylinder device 15*a* and the second cylinder device 15*b*, and the first pneumatic device 14*a* and the second pneumatic device 14*b*. The degree of freedom of the exoskeleton rehabilitation device 1 driven by the cylinder devices 15*a*, 15*b* and the pneumatic devices 14*a*, 14*b*, the simulation analysis based on kinematics and dynamics, the air pressure and electric control circuit design, and the selection of sensors and mechanical materials, the mechanical components of the machinery improve the flexibility, safety and lightweight significantly. Therefore, the method of using the cylinders to achieve the linear motion is more convenient than the use of the conventional motor and requires no additional retardation mechanism, and such method has the advantages of strong overload resisting capability and a cleaner effect than the conventional hydraulic driving system. The present invention improves the flexibility, safety and lightweight significantly and requires fewer driving elements, and the structure is simple rather than complex.

3. The present invention captures the conditions of each joint and both legs in a user's walking cycle, and uses the cylinder mechanism 73 to adjust the pressure relief valve 731 to set an appropriate weight reduction value, and send such information to the remote monitoring device 6 for analysis, and then sent the analyzed information to the processing unit 2 to control the coordination between the exoskeleton rehabilitation device 1 and the user, and also to the speed sensor of the treadmill 9 to control the speed of the treadmill 9 to match the speed of the user. Therefore, the user can obtain the best rehabilitation training, and the invention improves the walking rehabilitation effect.

4. The bottom of the support device 7 of the present invention has a moving device 78 and a fixing device 79, so that the user can move the support device 7 by the moving device 78 before/after the rehabilitation, and step on/down the treadmill 9 easily. During the rehabilitation, the support device 7 is fixed by the fixing device 79 and cannot be moved easily, so as to improve the safety of the rehabilitation.

What is claimed is:

1. A pneumatic lower extremity gait rehabilitation training system, comprising:

a support device including a support frame;

a center-of-gravity adjusting device coupled to a side of the support frame and facing a rear portion of a user; and an exoskeleton rehabilitation device including a first hip joint mechanism circumscribing a user's two hip joints, with a first hip joint outward-extending cylinder frame and a second hip joint outward-extending cylinder frame installed to respective ends of the first hip joint mechanism, the first hip joint outward-extending cylinder frame and the second hip joint outward-extending cylinder frame receiving a first pneumatic device installed therebetween, a second hip joint mechanism extending from a portion of the first hip joint mechanism disposed in correspondence with a rear portion of a user and extending towards the center-of-gravity adjusting device to be movably coupled thereto, the second hip joint mechanism being installed to a hip joint cylinder frame, the hip joint cylinder frame being pivotally coupled to a first cylinder device, the first cylinder device being coupled to a processing unit, the first hip joint mechanism being pivotally coupled to a thigh frame, the thigh frame being installed to a knee joint mechanism, the thigh frame and the knee joint mechanism being pivotally coupled to a first actuator, the knee joint mechanism being pivotally coupled to a calf frame, the calf frame being pivotally coupled to a second actuator, the second actuator being coupled to the processing unit, the knee joint mechanism and the calf frame being pivotally coupled to a third actuator, the third actuator being coupled to the processing unit, the first actuator and the second actuator being pivotally coupled to a second cylinder device, the calf frame being installed to an ankle joint mechanism, the ankle joint mechanism and the third actuator being installed to a second pneumatic device, the ankle joint mechanism being installed to a pedal device;

wherein gait of a user is adjusted responsive at least to the movement of a user relative to the center-of-gravity adjusting device.

2. The pneumatic lower extremity gait rehabilitation training system of claim 1, wherein the first hip joint mechanism is pivotally coupled to a first non-contact angle sensor, the knee joint mechanism is pivotally coupled to a second non-contact angle sensor, the ankle joint mechanism is pivotally coupled to a third non-contact angle sensor, the first non-contact angle sensor, the second non-contact angle sensor, and the third non-contact angle sensor generate corresponding signals indicative of respective angle displacements of the first hip joint mechanism, the knee joint mechanism, and the ankle joint mechanism in a walking cycle of the exoskeleton rehabilitation device to transmit the corresponding signals to the processing unit thereby controlling the first actuator, the second actuator, and the third actuator responsive to the corresponding signals received by the processing unit.

3. The pneumatic lower extremity gait rehabilitation training system of claim 1, wherein the thigh frame further includes a thigh-length adjustment mechanism, the calf frame further includes a calf-length adjustment mechanism, the thigh-length adjustment mechanism and the calf-length adjustment mechanism are provided for adjusting the lengths of a user's thigh and calf respectively.

4. The pneumatic lower extremity gait rehabilitation training system of claim 1, wherein the exoskeleton rehabilitation device further includes at least one fixing element.

5. The pneumatic lower extremity gait rehabilitation training system of claim 2, wherein the processing unit is coupled to a remote monitoring device, the remote monitoring device receiving the corresponding signals from the processing unit.

6. The pneumatic lower extremity gait rehabilitation training system of claim 1, wherein the support device includes at least one pulley installed at an end of the support frame, and a transmission unit links the pulley to the exoskeleton rehabilitation device, and an end of the transmission unit being installed to a cylinder mechanism having a pressure relief valve by a cylinder fixing plate, the cylinder mechanism being fixed to a side of the support frame, another end of the transmission unit being coupled to a balance bar, a suspension device extending from an end of the balance bar, and the suspension device being fixedly secured to a sheath portion configured to be worn by a user.

7. The pneumatic lower extremity gait rehabilitation training system of claim 6, wherein the suspension device further includes a pulling-force sensor for sensing center of gravity to stabilize at least a portion of a center of gravity of a user.

8. The pneumatic lower extremity gait rehabilitation training system of claim 6, wherein a bottom end of the support frame includes at least one moving device and at least one fixing device, the support frame moved horizontally by the moving device, the support frame positioned by the fixing device.

9. The pneumatic lower extremity gait rehabilitation training system of claim 6, wherein the support device further includes a center-of-gravity adjusting device installed to a side of the support frame by a first adjusting plate, the first adjusting plate is pivotally coupled to a first link rod, a second link rod, a third link rod, and a fourth link rod, and the first link rod and the first adjusting plate are pivotally coupled to a first gas driving unit, the second link rod and the first adjusting plate are pivotally coupled to a second gas driving unit, the first adjusting plate is installed to a second adjusting plate by the first link rod, the second link rod, the third link rod, and the fourth link rod, the second adjusting plate is installed to the second hip joint mechanism.

10. The pneumatic lower extremity gait rehabilitation training system of claim 1, wherein the processing unit is coupled to a treadmill and the treadmill is installed with a speed sensor.

11. A pneumatic lower extremity gait rehabilitation training system, comprising: an exoskeleton rehabilitation device including a first hip joint mechanism, with a first hip joint outward-extending cylinder frame and a second hip joint outward-extending cylinder frame installed to respective ends of the first hip joint mechanism, the first hip joint outward-extending cylinder frame and the second hip joint outward-extending cylinder frame receiving a first pneumatic device installed therebetween, the first hip joint mechanism being installed to a second hip joint mechanism, the second hip joint mechanism being installed to a hip joint cylinder frame, the hip joint cylinder frame being pivotally coupled to a first cylinder device, the first cylinder device being coupled to a processing unit, the first hip joint mechanism being pivotally coupled to a thigh frame, the thigh frame being installed to a knee joint mechanism, the thigh frame and the knee joint mechanism being pivotally coupled to a first actuator, the knee joint mechanism being pivotally coupled to a calf frame, the calf frame being pivotally coupled to a second actuator, the second actuator being coupled to the processing unit, the knee joint mechanism and the calf frame being pivotally coupled to a third actuator, the third actuator being coupled to the processing unit, the first actuator and the second actuator being pivotally coupled to a second cylinder device, the calf frame being installed to an ankle joint mechanism, the ankle joint mechanism and the third actuator being installed to a second pneumatic device, the ankle joint mechanism being installed to a pedal device;

wherein a first non-contact angle sensor is positioned at the first hip joint mechanism and is pivotally coupled thereto, a second non-contact angle sensor is positioned at the knee joint mechanism and is pivotally coupled thereto, a third non-contact angle sensor is positioned at the ankle joint mechanism and is pivotally coupled thereto, the first non-contact angle sensor, the second non-contact angle sensor, and the third non-contact angle sensor generate corresponding signals indicative of respective angular displacements of the first hip joint mechanism, the knee joint mechanism, and the ankle joint mechanism in a walking cycle of the exoskeleton rehabilitation device to transmit the corresponding signals to the processing unit thereby controlling the first actuator, second actuator, and third actuator responsive to the corresponding signals received by the processing unit.

12. A pneumatic lower extremity gait rehabilitation training system, comprising:

an exoskeleton rehabilitation device including a first hip joint mechanism, with a first hip joint outward-extending cylinder frame and a second hip joint outward-extending cylinder frame installed to respective ends of the first hip joint mechanism, the first hip joint outward-extending cylinder frame and the second hip joint outward-extending cylinder frame receiving a first pneumatic device installed therebetween, the first hip joint mechanism being installed to a second hip joint mechanism, the second hip joint mechanism being installed to a hip joint cylinder frame, the hip joint cylinder frame being pivotally coupled to a first cylinder device, the first cylinder device being coupled to a processing unit, the first hip joint mechanism being pivotally coupled to a thigh frame, the thigh frame being installed to a knee joint mechanism, the thigh frame and the knee joint mechanism being pivotally coupled to a first actuator, the knee joint mechanism being pivotally coupled to a calf frame, the calf frame being pivotally coupled to a second actuator, the second actuator being coupled to the processing unit, the knee joint mechanism and the calf frame being pivotally coupled to a third actuator, the third actuator being coupled to the processing unit, the first actuator and the second actuator being pivotally coupled to a second cylinder device, the calf frame being installed to an ankle joint mechanism, the ankle joint mechanism and the third actuator being installed to a second pneumatic device, the ankle joint mechanism being installed to a pedal device; and a support device including a support frame coupled to the exoskeleton rehabilitation device, the support device including at least one pulley installed at an end of the support frame and a transmission unit extending between two ends and coupling the pulley to the exoskeleton rehabilitation device, one of the ends of the transmission unit being installed to a cylinder mechanism having a pressure relief valve, the cylinder mechanism being installed to the transmission unit via a cylinder fixing plate and being secured to a side of the support frame, the other of the ends of the transmission unit being secured to a balance bar, a suspension device extending from an end of the balance bar and fixedly secured to a sheath portion configured to be worn by a user, wherein the cylinder mechanism is coupled to the processing unit to be controllably actuated for countering at least a portion of a gravitational force on a user.

* * * * *